US006066837A

United States Patent [19]

McCormick et al.

[11] Patent Number: 6,066,837

[45] Date of Patent: May 23, 2000

[54] METHOD AND APPARATUS FOR SABBATH COMPLIANCE COOKING PROCESS

[75] Inventors: DeWayne LeRoy McCormick, Yorba Linda; Dindo S. Uy, North Hollywood, both of Calif.

[73] Assignee: Thermador Corporation, Los Angeles, Calif.

[21] Appl. No.: 09/293,084

[22] Filed: Apr. 16, 1999

[51] Int. Cl.[7] ..... H05B 6/68; H05B 1/02

[52] U.S. Cl. ..... 219/702; 219/680; 219/720; 219/758; 219/506

[58] Field of Search ..... 219/702, 720, 219/756, 758, 506, 681, 685, 400, 412, 680

[56] References Cited

U.S. PATENT DOCUMENTS 4,031,435 6/1977 Zioni et al. ..... 361/186

4,506,120 3/1985 Fleischman ..... 200/43.19

5,808,278 9/1998 Moon et al. ..... 219/506

5,841,112 11/1998 Brooks et al. ..... 219/506

*Primary Examiner*—Philip H. Leung

*Attorney, Agent, or Firm*—Brooks & Kushman P.C.

[57] ABSTRACT

A method and apparatus for controlling a cooking apparatus operates at least one cooking energy source with a control including switches that reduce the input manipulations required by a user and responses to component manipulations in order to operate one or more of the cooking energy sources to complete a cooking operation. The control responds to a first selection of the Sabbath operating mode and responds to a second selection for setting a first cooking source and at least one related feature function. An actuator maintains the performance status of the cooking energy source and the related feature, and disables the selectors during maintained performance.

5 Claims, 3 Drawing Sheets

METHOD AND APPARATUS FOR SABBATH COMPLIANCE COOKING PROCESS

TECHNICAL FIELD

The present invention relates to methods and apparatus for controlling a cooking appliance that complies with religious faiths' "no work" requirement by limiting the need for and the response to user input to perform cooking processes during a Sabbath period.

BACKGROUND ART

Cooking appliances have been available, for example, Thermador lines of built-in wall ovens, that feature automated cooking processes. However, some religious regulations do not permit practitioners to actuate or to cause changes in the status of functioning devices during Sabbath periods. One previously known process intended to avoid infractions of the regulations does deactivate some features but imposes a delayed response to opening or closing of a door and does not reduce the change in status of all features.

DISCLOSURE OF INVENTION

The present invention overcomes the above mentioned disadvantages by reducing the need for control actuation, and limiting the response to cooling appliance interaction, by automating a continuous status of cooking appliance features including cooking energy sources such as heating elements and related appliance operating features such as lights, displays or the like. In a preferred example, the programming of the Sabbath mode described above is simplified by time shifting user chosen selections prior to the Sabbath and interrupting response to additional actuations or terminations until after the Sabbath period or the process is otherwise terminated.

To select the Sabbath mode, the oven should be off, the timers should be off, and the oven should be idle. The status of the oven lights during the Sabbath period may be on or off for each of the ovens to which the control is applied. The status of the lights will be locked in as soon as the Sabbath mode is activated. In a multiple oven appliance, one or more ovens may be set in Bake mode in the usual manner. In the preferred embodiment, no Time Bake, Delayed Time Bake, Probed Bake or Combination Bake, a combination of multiple cooking energy sources, is actuatable or allowed by the control in the Sabbath operating mode. The Sabbath mode will not be activated if the conditions stated above are not satisfied.

Once activated to operate in the Sabbath mode, the word "Sab" is displayed in the cooktime digits display of the active oven(s). If one oven is on "Sab" is displayed in the cooktime digits of that oven display. If multiple ovens are on, "Sab" is displayed in the cooktime digits of the separate cooktime digits displays for each of the ovens. The lights will stay in the status set prior to the activation of the Sabbath mode. If the lights are off, opening the door will not turn on the lights. In the preferred embodiment, all keys, except the Oven Off keys, will be inactive during the Sabbath mode. No active key or inactive key tones will be generated. In line with the current non-Sabbath Bake mode, the display of the word PREHEAT and the toggling of the oven temperature and the set temperature may continue in the preferred embodiment to function even in the Sabbath mode. Nevertheless, a preheat tone will not be generated in the preferred embodiment when the oven temperature reaches the set temperature. An indicia, such as a red element icon that will be illuminated whenever there is a call for heat from that element, may change as necessary to reflect a current condition of a feature. Conversely, the indicia, for example, a red element icon that will not illuminated whenever there is no call for heat, may be extinguished as necessary to reflect a current condition of a feature. If the door is opened when the element is on, the element will stay on. To turn off the Sabbath mode, the user turns off all active ovens.

The examples above are for illustration purposes only. The number and definitions of operating features and related operating features, such as illumination, audio indicia and visual indicia, the number, type and operation of each heating source, and the number and types of reduced functions may be defined in numerous specifications and standards within the controller without departing from the present invention.

BRIEF DESCRIPTION OF DRAWINGS

The present invention will be more fully understood by reference to the following detailed description of a preferred embodiment of the present invention when read in conjunction with the accompanying drawing in which like reference characters refer to like parts throughout the views, and in which.

BEST MODE FOR CARRYING OUT THE INVENTION

Figure 1:
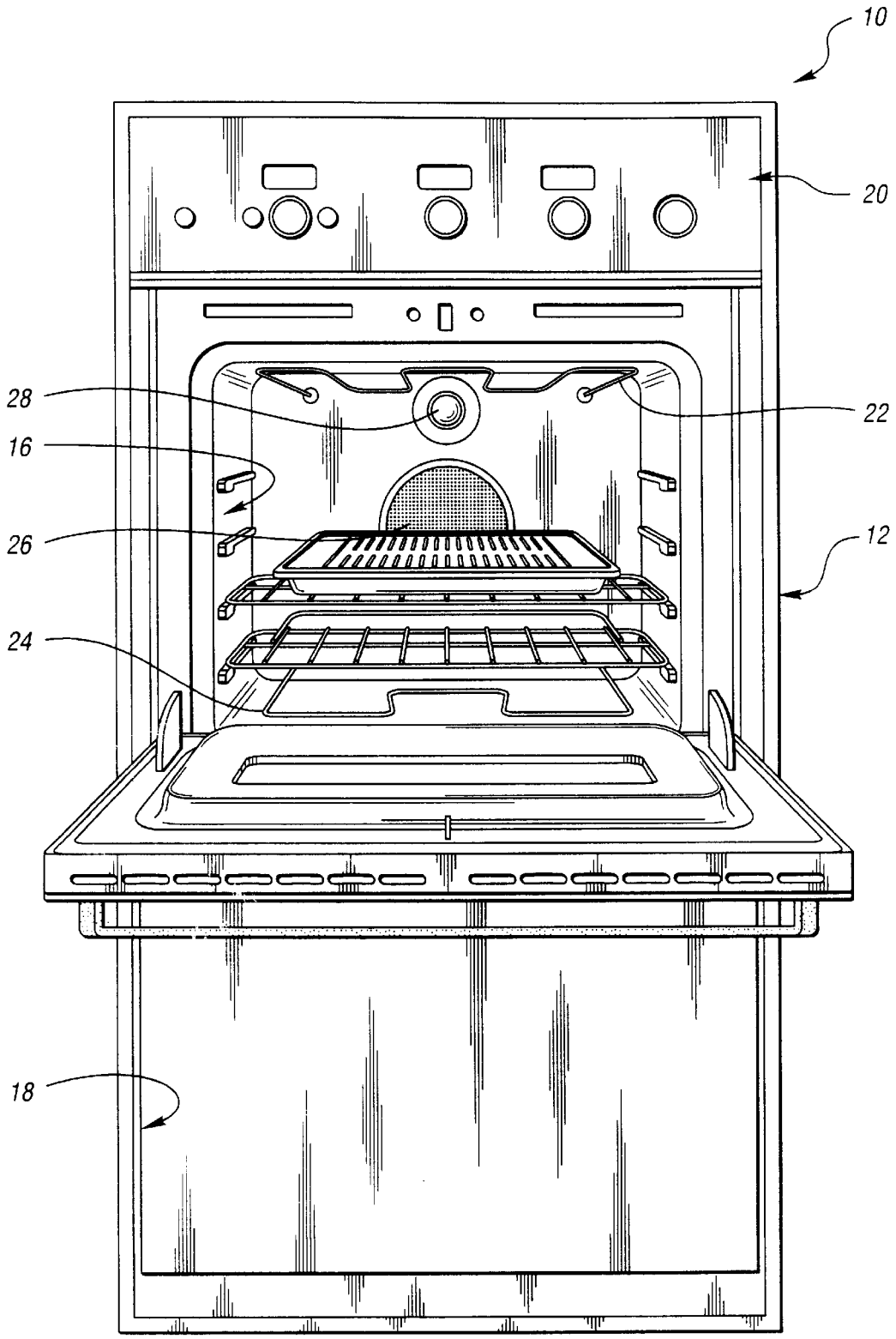
FIG. 1 is a front view of a cooking appliance with a plurality of cooking energy sources controlled in accordance with the method and apparatus of the present invention.

Referring first to FIG. 1, a cooking appliance 10 is shown including an oven 12 with a plurality of cooking energy sources in communication with the cooking chamber 16. In addition, an oven chamber 18 also containing elements for the same or different cooking energy sources can also be provided in the additional oven 18 of the appliance as shown in phantom line in FIG. 1. Regardless of the number of oven chambers, the cooking appliance 10 includes a control panel 20 and enables the user to provide input, preferably to a microprocessor-based control system 21 to be described in greater detail below, that automatically operates one or more cooking energy sources in a predetermined, controlled manner to perform a complete cooking process.

Moreover, while the control panel 20 is incorporated as a structural portion of the appliance in the preferred embodiment, it is to be understood the control and the switches actuated by the user may be physically external to the appliance, for example, a universal control for all appliances in a room or building, and may also incorporate remote control technology that does not require a user's presence immediately in front of the appliance.

In the preferred embodiment, the appliance includes a plurality of cooking energy sources including a baking cooking source, such as the source including heating elements such as the upper broiler heating element 22 and the lower baking element 24. The baking and broiling features may be further enhanced where a convection fan is employed during operation of one or more of the heating elements. Nevertheless, the preferred embodiment includes a convection thermal cooking source 26 that has a heating element associated with the fan and operated independently of the baking elements 22 and 24. The cooking chamber 16 also includes a microwave generator 28 to provide an additional cooking energy source within the chamber 16 that may be used independently or cooperatively with the other heating elements. The present invention may also be employed with these sources and other cooking energy sources such as jet impingement heaters, without departing from the scope and spirit of the present invention.

Figure 2A:
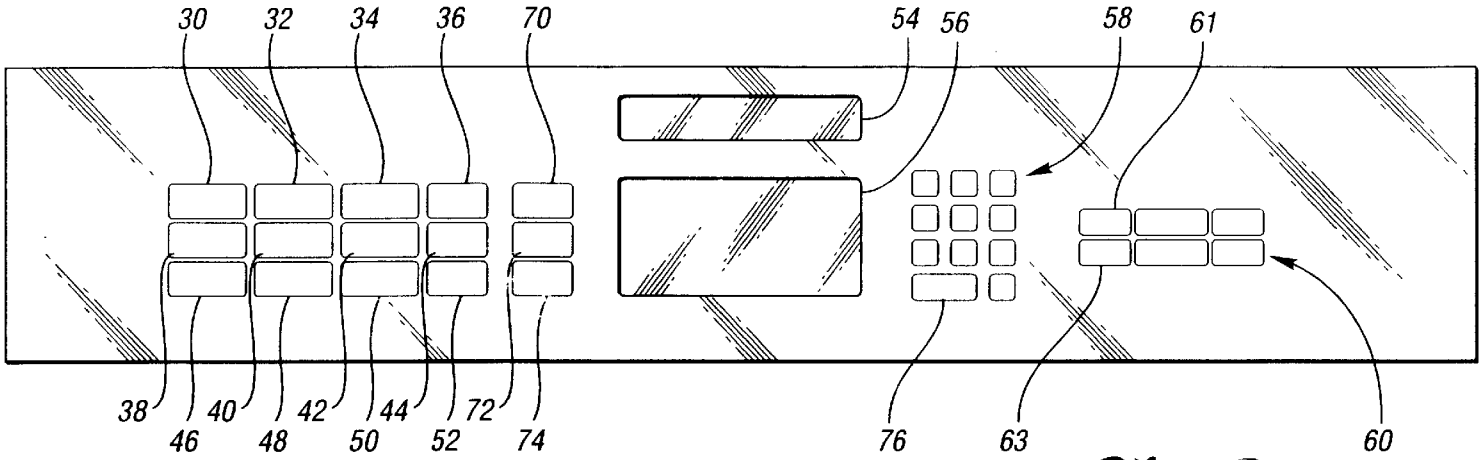
FIG. 2*a* is an enlarged front view of a preferred control panel shown in the cooking appliance in FIG. 1 with legends removed for the sake of drawing formality.
Figure 2B:
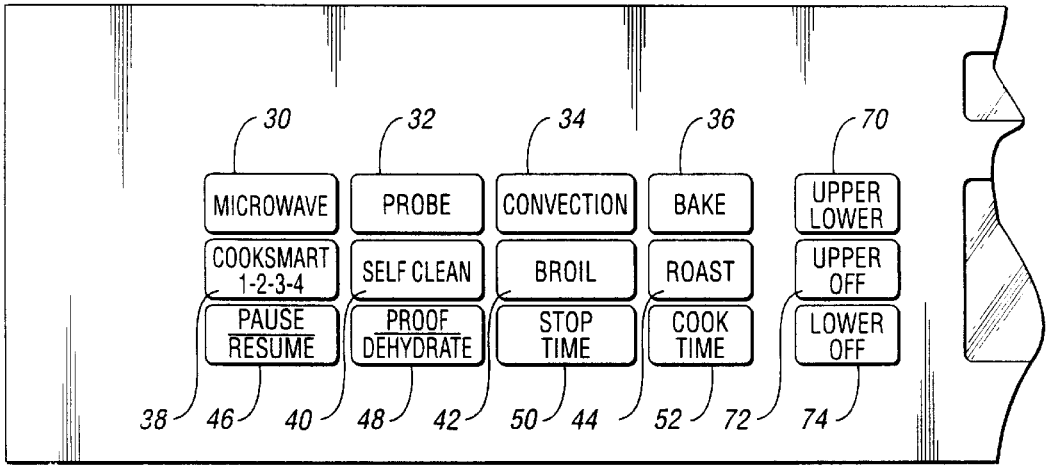
FIGS. 2*b* and 2*c* are enlarged left and right ends, respectively, of the control panel shown in FIG. 2*a*.
Figure 2C:
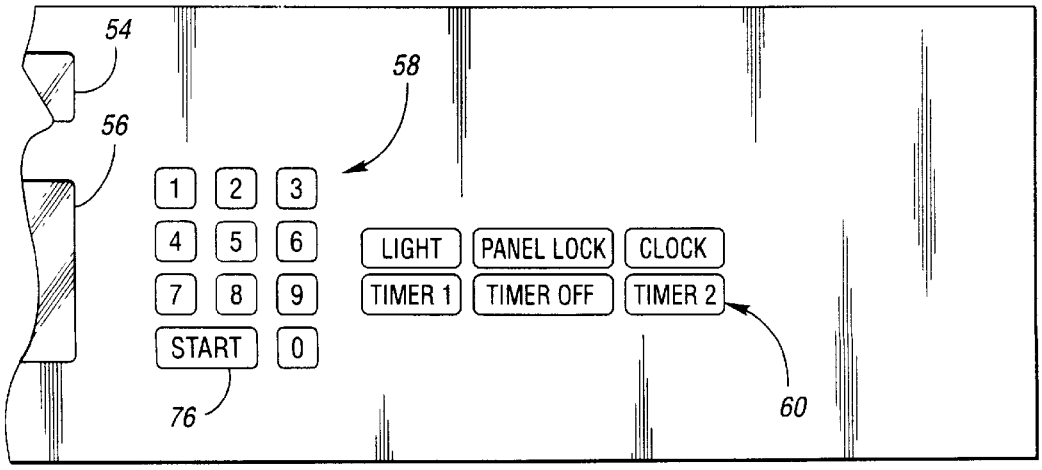

Referring now to FIG. 2, control panel 20 includes tactile switches, preferably in the form of touch sensing switches covered by a face panel to limit exposure of the active switch components and to avoid protruding switch parts through the panel. Each touch pad switch is marked by indicia as shown at reference characters 30–52. In addition, a keypad 58 and a keypad 60 each with a plurality of switches complete the user interface of the control. In view of the numerous controls, cooking sources and operating functions in the cooking appliance 10, it will be understood that a procedure of input switch actuations may be required to perform cooking functions, without a processor control of the present invention to limit actuatable switches and limit responses to manipulated components such as the door or switches.

Figure 3:
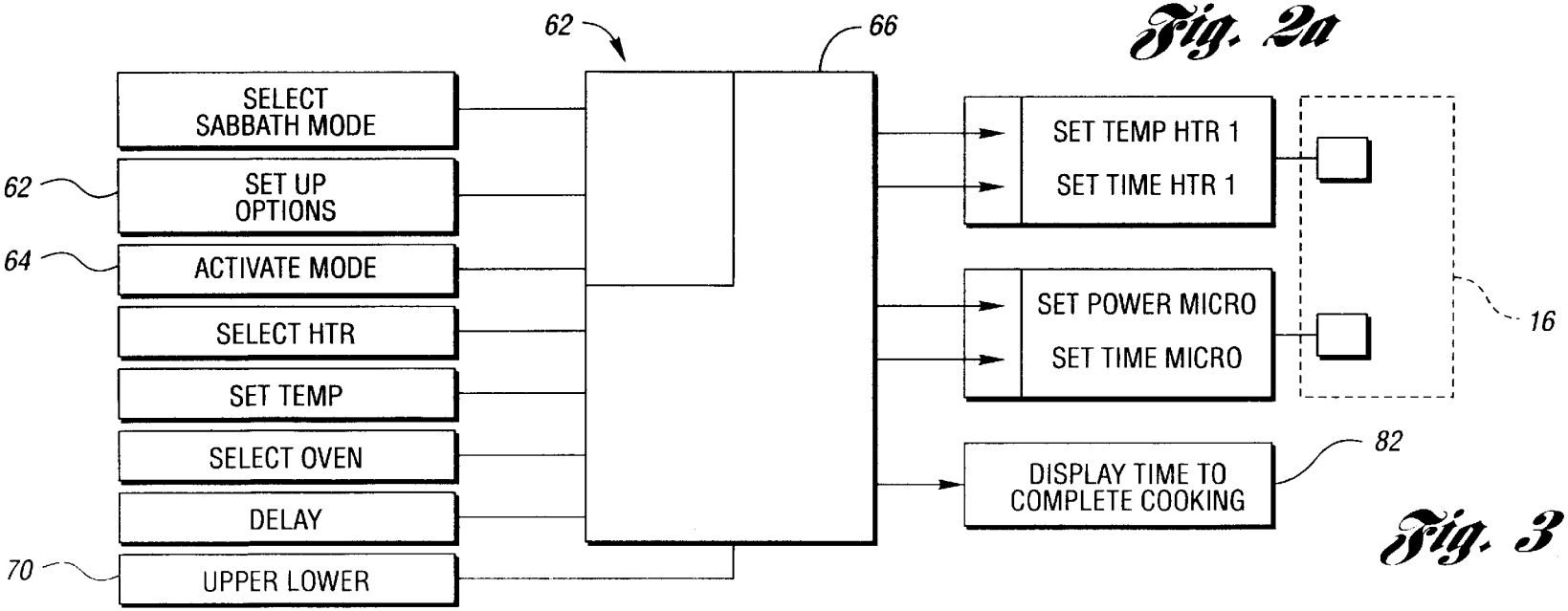
FIG. 3 is a diagrammatic view of the inputs and outputs to the cooking appliance control constructed in accordance with the present invention.

Referring now to FIG. 3, the Sabbath mode automated cooking process control 62 automatically sets operating parameters for and actuates at least one cooking energy source. Preferably the temperature of the oven is set by maintaining the standard operation of conventional thermal heating elements 24 once the Sabbath mode is actuated. Preferably, all other cooking sources and cooking related features, such as the door light switch, are deactivated or made inoperative by the controller despite door opening or closing.

To select the Sabbath mode, the user cancels all other modes such as "timed bake" or "probe" modes already selected. The user sets options such as which oven by touching UPPER LOWER switch 72. The user then selects BAKE mode with switch 36 and temperature by touching BAKE switch 36 and the operating temperature switches at keypad 58. The user then selects START by touching START switch 76. A user may select the "on" status for the lights by touching the LIGHTS switch 61 at keypad 60. However, the lights may be kept off throughout the Sabbath day by omitting this step. In addition, the processor option inputs may be modified to permit or reduce the actuatable components or responses to appliance component manipulations as set up in a predetermined set of responses programmed or otherwise enabled in the control 62. Accordingly, some functions such as oven illumination may be set to adjust compliance with "no work" requirements while limitation or reduction of functions or related features such as indicia designating power to the heating element may not be optionally eliminated by the user for design considerations.

In the preferred embodiment, the Sabbath mode is actuated by touching and holding TIMER OFF switch 63 for five seconds. By activating the Sabbath mode as discussed above, the word "Sab" is displayed at display 56. The lights will remain on or off as previously set, if the door is open or closed. "Preheat" is displayed at display 56 until the oven reaches temperature. All pads, except the oven OFF, will be inactive. No chime or beep signal will be generated. Ovens [bake heating elements?] will remain "on" indefinitely until canceled. Preferably, a red "heating" symbol in the display is illuminated whenever power is applied to the bake element. However, opening the door will not cause the heating element to be activated, since it will already be on. The heating element will remain on, while the door is open under this condition.

To cancel or stop the Sabbath mode, the user touches oven OFF switch 72 or 74 or both. The user may then select switch 61 of keypad 60 to turn off the light, if it was set to stay on. To set both ovens on the Sabbath mode, the user selects one oven at a time and repeats the above process for each oven. The activating step described above is performed only once after both ovens are selected and set to input option parameters, for example, by the previously described procedures.

While the preferred embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

Having thus described a preferred embodiment of the present invention, many modifications will become apparent to those skilled in the art to which it pertains without departing from the scope and spirit of the present invention as defined in the appended claims.

What is claimed is:

1. A control for a cooking apparatus having at least one cooking energy source and related operation features, and a processor responsive to a set of tactile switches, the control comprising;

a first selector for selecting a Sabbath mode operation prior to a Sabbath period, a second selector for setting a performance status of operating at least one energy source and a performance status of at least one related feature during a time duration corresponding to not less than a Sabbath period, an operator responsive to said first and second selectors for controlling operating parameters and maintaining the performance statuses of said at least one energy source and said at least one related feature[s], and disabling said selectors during said maintained performance.

2. The invention as defined in claim 1 wherein said first selector comprises a process selection switch.

3. The invention as defined in claim 1 wherein said cooking energy supply sources are taken from the group consisting of a convection heater, a microwave heater, a jet impingement heater and a baking element.

4. The invention as defined in claim 1 wherein said performance status at said at least one related feature is operating an oven light.

5. A method for cooking in compliance with "no work" Sabbath requirements in an appliance having at least one plurality cooking energy source and at least one related feature, the method comprising:

selecting a Sabbath mode operation prior to a Sabbath mode period, setting a performance status of operating at least one energy source and a performance status of at least one related feature during a period not less than a Sabbath period, and actuating and maintaining the performance status of said at least one energy source and said related feature, and disabling said selectors during said maintained performance.

* * * * *

UNITED STATES PATENT AND TRADEMARK OFFICE

CERTIFICATE OF CORRECTION

PATENT NO. : 6,066,837

DATED : May 23, 2000

INVENTOR(S) : DeWayne L. McCormick, et al.

It is certified that error appears in the above-identified patent and that said Letters Patent is hereby corrected as shown below:

Column 4, Line 40, Claim 1: delete "feature[s]" and insert --feature--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*